US007484943B2

(12) United States Patent
Izawa et al.

(10) Patent No.: US 7,484,943 B2
(45) Date of Patent: Feb. 3, 2009

(54) SCREW PUMP WITH IMPROVED EFFICIENCY OF DRAWING FLUID

(75) Inventors: Yuya Izawa, Kariya (JP); Shinya Yamamoto, Kariya (JP); Masahiro Inagaki, Kariya (JP); Makoto Yoshikawa, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 0 days.

(21) Appl. No.: 11/891,532

(22) Filed: Aug. 9, 2007

(65) Prior Publication Data

US 2008/0044304 A1 Feb. 21, 2008

(30) Foreign Application Priority Data

Aug. 11, 2006 (JP) ..... P2006-219332

(51) Int. Cl.
*F04C 2/00* (2006.01)
*F04C 11/00* (2006.01)
*F04C 23/00* (2006.01)

(52) U.S. Cl. ..... 418/9; 418/201.1; 418/201.3

(58) Field of Classification Search ..... 418/5, 418/9, 201.1, 201.3
See application file for complete search history.

(56) References Cited

U.S. PATENT DOCUMENTS

| | | | | |
|---|---|---|---|---|
| 3,424,373 | A * | 1/1969 | Gardner | 418/201.1 |
| 3,807,911 | A * | 4/1974 | Caffrey | 418/9 |
| 4,792,294 | A * | 12/1988 | Mowli | 418/9 |
| 5,667,370 | A * | 9/1997 | Im | 418/9 |
| 6,257,854 | B1 * | 7/2001 | Fang et al. | 418/194 |
| 6,359,411 | B1 | 3/2002 | Kösters et al. | |
| 6,508,639 | B2 * | 1/2003 | Chen et al. | 418/9 |
| 2005/0244294 | A1 * | 11/2005 | Murakami et al. | 418/201.1 |
| 2006/0216189 | A1 | 9/2006 | Ohmi | |

FOREIGN PATENT DOCUMENTS

| | | | |
|---|---|---|---|
| JP | 03111690 | A * | 5/1991 |
| JP | 11-270485 | | 10/1999 |
| JP | 2001-055992 | | 2/2001 |
| JP | 2001-182679 | | 6/2001 |
| JP | 2001-193677 | | 6/2001 |
| JP | 2001-182679 | | 7/2001 |
| JP | 2001-193677 | | 7/2001 |

* cited by examiner

*Primary Examiner*—Theresa Trieu
(74) *Attorney, Agent, or Firm*—Morgan & Finnegan, LLP

(57) ABSTRACT

A screw pump includes a housing and a pair of intermeshing screw rotors. The housing has an inlet port and an outlet port. Each rotor has a first portion whose lead angle decreases. The first portion and the housing form an inlet space and a pump space. Winding angle of the first portion has a first region and a second region. The first region is located in a predetermined range from the end on the first portion adjacent to the inlet port toward the outlet port. The second region is located adjacent to the first region. Reduction rate of the lead angle of the first portion in the first region is set smaller than that in the second region. The maximum lead angle of the first portion is set smaller than a lead angle which decreases at a constant rate in the first region and the second region.

5 Claims, 7 Drawing Sheets

SCREW PUMP WITH IMPROVED EFFICIENCY OF DRAWING FLUID

BACKGROUND OF THE INVENTION

The present invention relates to a screw pump having a pair of intermeshing screw rotors.

As a conventional screw pump, a screw fluid machine is disclosed by Japanese Patent Application Publication No. 2001-182679 or No. 2001-193677. This type of screw pump includes a pair of intermeshing screw rotors and a housing for accommodating the rotors. The housing has an inlet port at one end thereof for allowing fluid to be drawn therethrough into the housing, and an outlet port at the other end thereof for allowing the fluid to be discharged therethrough out of the housing. Each rotor is of a single-start thread and its lead angle decreases steplessly at a constant rate as the thread of the rotor approaches the outlet port thereby to form a changing lead portion of the rotor. It is noted that the lead angle is an angle made between a plane that is perpendicular to the axis of the rotor and the helix of the thread of the rotor. As the screw pump is operated, the fluid approaches the outlet port while decreasing its volume.

The same kind of technique is disclosed by Japanese Patent Application Publication No. 2001-55992 or No. 11-270485. Japanese Patent Application Publication No. 2001-55992 discloses a displacement machine for compressible medium, and its rotors are of a multi-start thread. Each rotor includes a changing lead portion that decreases steplessly at a constant rate as the thread of the rotor approaches the outlet port, and a constant lead portion whose lead angle is constant. Japanese Patent Application Publication No. 11-270485 discloses a vacuum pump including a pair of rotors each having a changing lead portion and a constant lead portion.

Meanwhile as the space closed by a pair of rotors and the housing at the time of one rotation of the rotors, or one turn, is large, working efficiency of drawing the fluid into the screw pump improves. The space is hereinafter referred to as a pump space. In the above techniques disclosed by the four references, however, there is not disclosed concrete structure for positively increasing the volume of the closed pump space formed by the changing lead portion. That is, in each of the conventional screw pumps, the volume of the pump space formed by the changing lead portion is not necessarily set as a suitable volume for improving the efficiency.

The present invention is directed to a screw pump having a pair of screw rotors with a changing lead portion whose lead angle changes, wherein volume of a pump space of the screw pump which is closed at the time of one turn of the rotors is increased compared to that of the conventional screw pump thereby to improve efficiency of drawing fluid into the screw pump.

SUMMARY OF THE INVENTION

In accordance with an aspect of the present invention, a screw pump includes a housing and a pair of screw rotors. The housing has an inlet port at one end thereof and an outlet port at the other end thereof. The screw rotors are disposed in the housing in engagement with each other. Each rotor has a first portion whose lead angle decreases from an end on the rotor adjacent to the inlet port toward the outlet port. The first portion and the housing form an inlet space and a pump space. The inlet space is located at an end of the first portion adjacent to the inlet port and is in communication with the inlet port. The pump space is closed adjacent to the inlet space. Winding angle of the first portion has a first region and a second region.

The first region is located in a predetermined range from the end on the first portion adjacent to the inlet port toward the outlet port. The second region is located adjacent to the first region. Reduction rate of the lead angle of the first portion in the first region is set smaller than that in the second region. The maximum lead angle of the first portion is set smaller than a lead angle which decreases at a constant rate in the first region and the second region.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
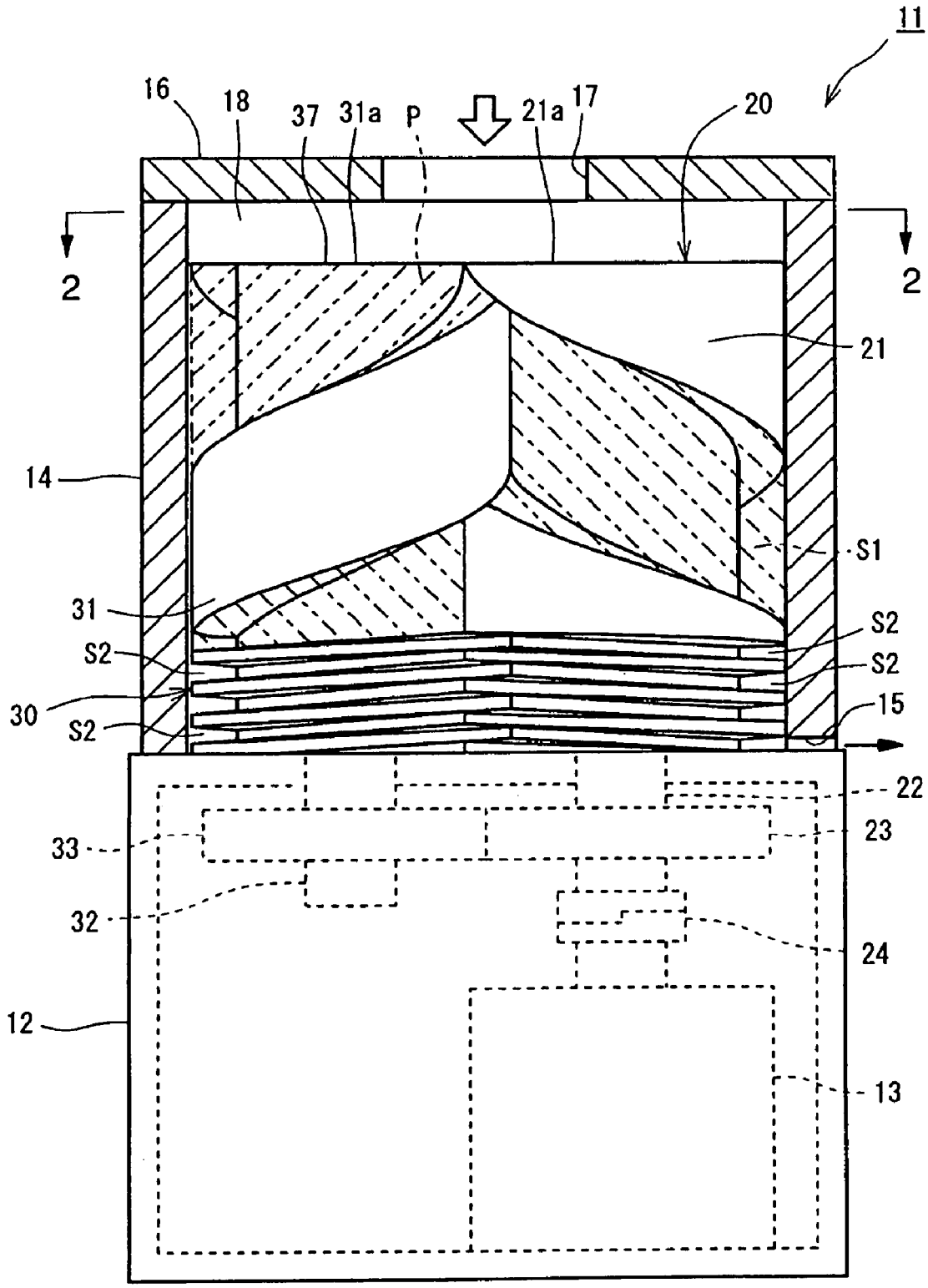
FIG. 1 is a longitudinal sectional view showing a screw pump according to a first embodiment of the present invention.
Figure 2:
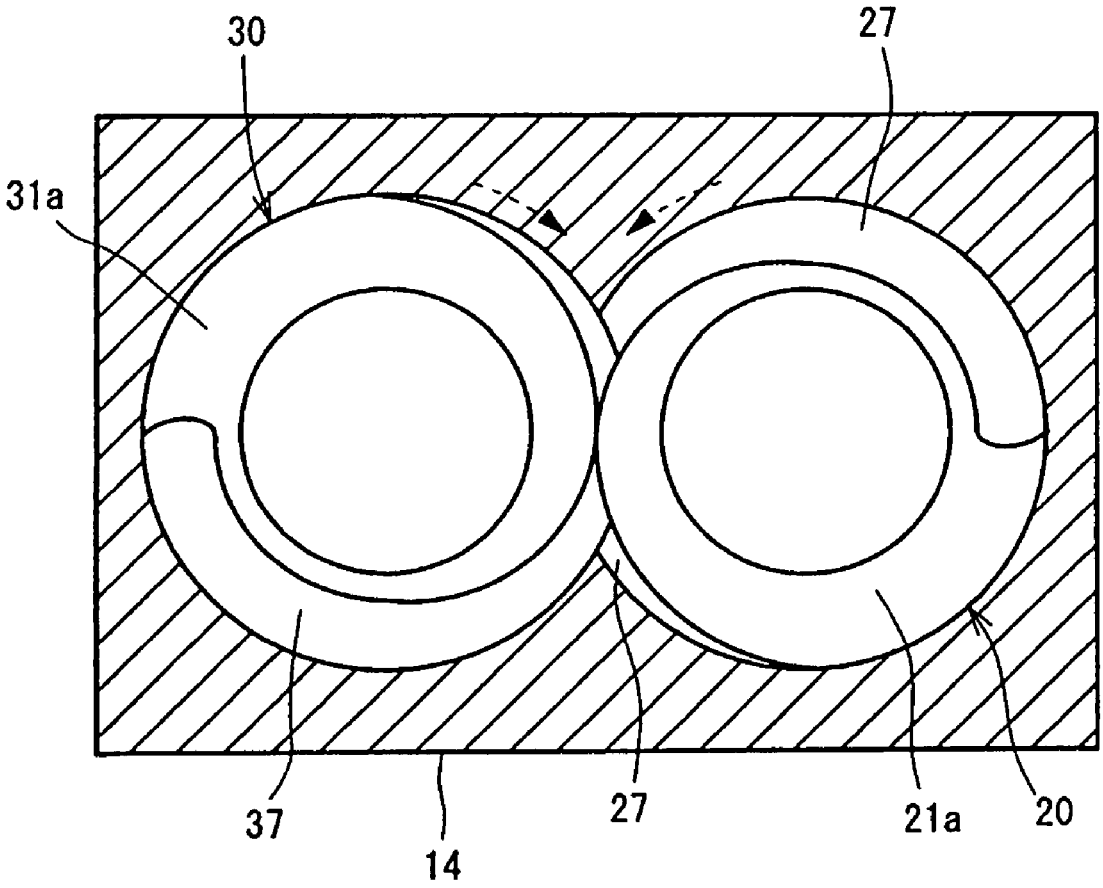
FIG. 2 is a cross sectional view taken along the line 2-2 of FIG. 1.

The following will describe a screw pump according to a first embodiment of the present invention with reference to FIGS. 1 to 4. FIG. 1 is a longitudinal sectional view showing a screw pump of the first embodiment, and FIG. 2 is a cross sectional view taken along the line 2-2 of FIG. 1. Referring to FIG. 1, the screw pump 11 is of a vertical type and used as a vacuum pump in the process of manufacturing semiconductors. The screw pump 11 includes a gear case 12, a rotor housing 14, an upper housing 16 and a pair of intermeshing screw rotors 20, 30. The rotor housing 14 has a cylindrical shape and is joined to the upper end of the gear case 12. The upper housing 16 has a flat shape and is joined to the upper end of the rotor housing 14. The rotors 20, 30 engaged with each other are provided in the rotor housing 14.

The gear case 12 houses therein an electric motor 13 for driving the screw pump 11, a pair of intermeshing gears 23, 33 and a coupling 24. The gears 23, 33 allow the rotors 20, 30 to rotate in the opposite directions. The coupling 24 is operable to transmit torque of the electric motor 13 to the rotors 20, 30 or to cut off the torque of the electric motor 13.

The rotor housing 14 forms a space whose shape corresponds to the shape of the intermeshing rotors 20, 30. As shown in FIG. 2, the horizontal section of the space is provided roughly by a figure "8". An outlet port 15 is formed in the rotor housing 14 at a position adjacent to the gear case 12, through which the space in the rotor housing 14 communicates with an external fluid circuit (not shown), so that the fluid in the screw pump 11 is delivered to the external fluid circuit through the outlet port 15. The rotor housing 14 and the gear case 12 are joined to each other by a fixing member such as a bolt (not shown).

The upper housing 16 closes the upper end of the rotor housing 14. An inlet port 17 is formed through the center of the upper housing 16. Through the inlet port 17, the space for the rotors 20, 30 and the external fluid circuit are in communication with each other, so that the fluid in the external fluid circuit is drawn into the screw pump 11 through the inlet port 17. Although the screw pump 11 has the inlet port 17 and the outlet port 15, the space of the screw pump 11 is substantially closed by the upper end of the gear case 12, the rotor housing 14 and the upper housing 16.

In the present embodiment, end faces 21*a*, 31*a* of screw bodies 21, 31 of the rotors 20, 30 adjacent to the inlet port 17 are spaced away from the lower end face of the upper housing 16 at a predetermined distance so that an inlet chamber 18 is formed in the rotor housing 14 in facing relation to the end faces 21*a*, 31*a* of the screw bodies 21, 31.

The rotors 20, 30 will now be described. In the present embodiment, the rotor 20 is the drive rotor while the rotor 30 is the driven rotor. The drive rotor 20, the driven rotor 30 and the rotor housing 14 cooperate to form a plurality of working chambers, through which the fluid is transferred from the inlet port 17 to the outlet port 15 while being compressed.

The drive rotor 20 will now be described more in detail. The drive rotor 20 is driven to be rotated by the electric motor 13. The drive rotor 20 has the screw body 21 accommodated in the space of the rotor housing 14, a drive shaft 22 which extends out into the gear case 12, and the gear 23 or a drive gear mounted on the drive shaft 22. The drive shaft 22 is rotatably supported by the gear case 12 through a bearing (not shown) and connected at the end thereof to the coupling 24, which is in turn connected to the electric motor 13. The drive gear 23 engages with the gear 33 as a driven gear of the driven rotor 30 for transmitting torque of the drive rotor 20 to the driven rotor 30.

Figure 3:
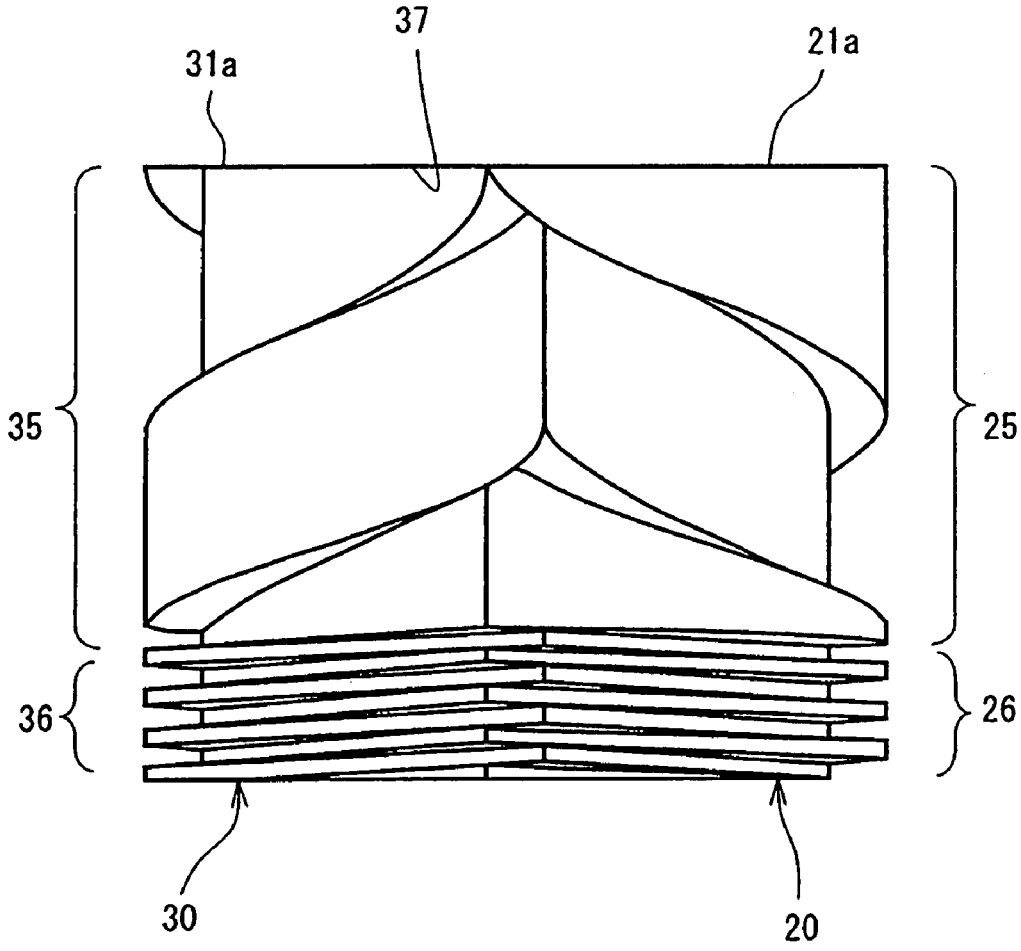
FIG. 3 is a front view showing relevant part of the screw pump of the first embodiment.
Figure 3:
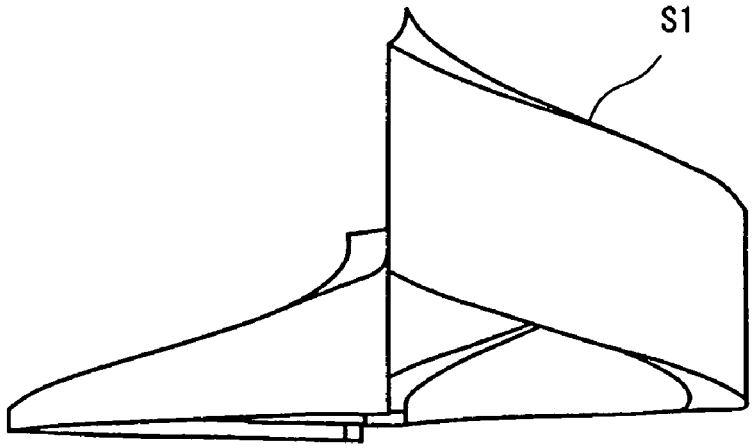

The screw body 21 of the drive rotor 20 is of a single-start thread having a helical thread and a thread groove. As shown in FIG. 3, the screw body 21 has a first portion 25 and a second portion 26. The first portion 25 is formed extending from the end of the screw body 21 adjacent to the inlet port 17 to the vicinity of the outlet port 15. The second portion 26 is formed extending continuously from the first portion 25 to the end of the screw body 21 facing the gear case 12. As shown in FIG. 3, lead angle of the first portion 25 (i.e. an angle made between a plane that is perpendicular to the axis of rotation of the rotor 20 and the helix of the thread of the rotor 20) decreases progressively from the end on the drive rotor 20 adjacent to the inlet port 17 toward the outlet port 15, while the second portion 26 has a constant lead angle. Therefore, the lead angle of the first portion 25 of the drive rotor 20 is the maximum at the end of the drive rotor 20 adjacent to the inlet port 17, or at the end face 21*a*. The decrease of the lead angle of the first portion 25 will be described in detail later.

On the other hand, the lead angle of the second portion 26 of the drive rotor 20 is constant and set at the same lead angle as the minimum lead angle of the first portion 25. The end face 21*a* of the screw body 21 of the drive rotor 20 is perpendicular to the rotary axis of the drive rotor 20. As shown in FIG. 2, the end face 21*a* is formed with an inlet opening 27 at which the thread groove starts.

The driven rotor 30 will now be described. The driven rotor 30 is rotated with the drive rotor 20. The driven rotor 30 has the screw body 31 accommodated in the space of the rotor housing 14, a driven shaft 32 which extends out into the gear case 12, and the driven gear 33 mounted on the driven shaft 32. Like the screw body 21 of the drive rotor 20, the screw body 31 of the driven rotor 30 is of a single-start thread having a helical thread and a thread groove. As shown in FIG. 3, the screw body 31 of the driven rotor 30 has a first portion 35 and a second portion 36. As shown in FIG. 2, the end face 31*a* of the driven rotor 30 is provided with an inlet opening 37.

As indicated earlier herein, the rotors 20, 30 intermesh with each other. Therefore, an inlet space P is formed at the end of the first portions 25, 35 of the rotors 20, 30 adjacent to the inlet port 17 and is in communication with the inlet openings 27, 37. The inlet space P is also in communication with the inlet port 17 through the inlet openings 27, 37. As shown in FIG. 1, the inlet space P is indicated by hatching with chain double-dashed line at the end of the rotors 20, 30 adjacent to the inlet port 17. The inlet space P is a space into which the fluid is drawn through the inlet port 17 and changes its volume in accordance with the rotation of the rotors 20, 30.

As shown in FIG. 1, a closed pump space S1 is formed adjacent to the inlet space P and is indicated by another hatching with chain double-dashed line. Referring to FIG. 3, the pump space S1 formed by the screw bodies 21, 31 and the rotor housing 14 is shown separately from the rotors 20, 30. The rotors 20, 30 are shown on the upper side of FIG. 3 and the pump space S1 is shown on the lower side thereof. It is noted that the position of the rotors 20, 30 when the communication between the inlet space P and the inlet port 17 is just blocked thereby to form the closed pump space S1 will be referred to as the starting position of one turn of the rotors 20, 30 or as 0° of rotation angle of the rotors 20, 30. When the operation where the rotors 20, 30 complete one rotation in the opposite direction from the position of rotation angle 0° to the position of rotation angle 360° is defined as one turn of the rotors 20, 30, the pump space S1 is formed at the time of one turn of the rotors 20, 30. The pump space S1 is a space into which the fluid in the inlet space P is transferred at the time of one turn of the rotors 20, 30. FIG. 2 shows the state at the time of ½ turn (or at the time of rotation angle of 180°) of the rotors 20, 30.

In the present embodiment, a plurality of pump spaces S2 are formed adjacent to the pump space S1 by the second portions 26, 36 and the rotor housing 14. The pump spaces S2 are formed successively and moved toward the outlet end of the rotors 20, 30. The volume of the pump spaces S2 which are provided in the region of the second portions 26, 36 of the rotors 20, 30 remains unchanged due to a constant lead angle of the helical threads in the second portions 26, 36. Each of the pump spaces S1, S2 corresponds to the working chamber.

Figure 4:
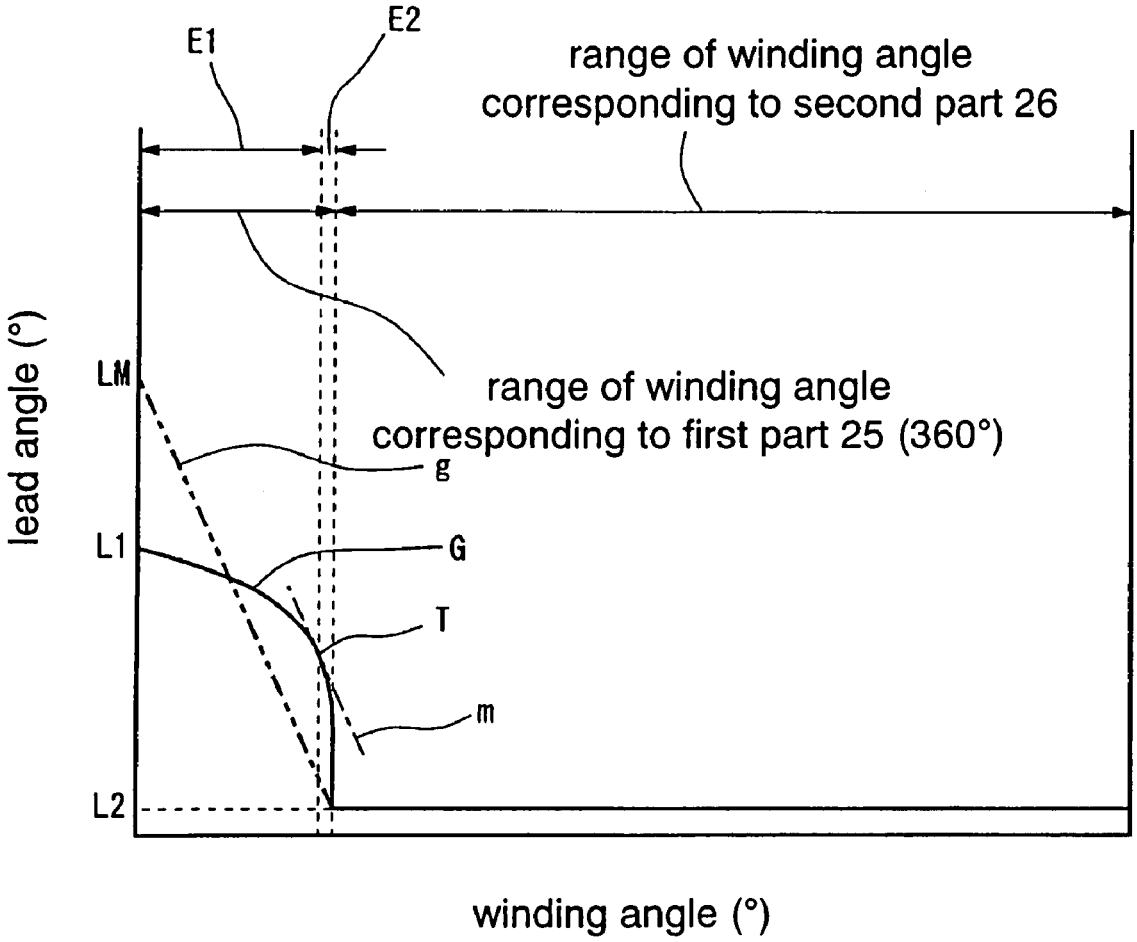
FIG. 4 is a graph showing relationship between winding angle and lead angle of the first embodiment.

The decrease of the lead angle of the first portion 25 of the screw body 21 will now be described with reference to FIG. 4. FIG. 4 is a graph showing the relationship between the winding angle (on the horizontal axis) and the lead angle (on the vertical axis) of the screw body 21. The winding angle is an angle where the helix of the thread of the screw body 21 is wound around the rotary axis of the rotor 20. The reference point of the horizontal axis of the graph is located at the end of the rotor 20 adjacent to the inlet 17, which is defined as 0° of winding angle. The winding angle corresponds to the number of helical turns of the thread, which increases with the winding angle.

A shown in FIG. 4, the graph G shows decrease of the lead angle in a range from the starting point of the winding angle (winding angle 0°) to a predetermined winding angle (winding angle 360°). In addition, the graph G shows the constant lead angle in a range from the predetermined winding angle (winding angle 360°) to the terminal point of winding angle. The range of winding angle of the graph G ranging from the starting point of winding angle (winding angle 0°) to the predetermined winding angle (winding angle 360°) corresponds to the first portion 25. Even when the winding angle of the graph G increases from the predetermined winding angle corresponding to a predetermined lead angle L2 until the terminal point of the winding angle (or until the outlet end in the case of FIG. 4), the constant lead angle L2 is kept. The range of winding angle of the graph G whose lead angle is constant corresponds to the second portion 26.

The decrease of the lead angle of the first portion 25 will be further mentioned. The lead angle of the first portion 25 decreases gradually from the starting point of the winding angle (or from the end of the rotor 20 adjacent to the inlet port 17) to a predetermined point of the rotor 20. The range of winding angle of the graph G whose lead angle decreases gradually is defined as a first region E1. Then, the lead angle decreases rapidly compared to the lead angle in the first region E1. The range of winding angle of the graph G whose lead angle decreases rapidly as the winding angle increases from the first region E1 is defined as a second region E2.

A graph g shows linear decrease of the lead angle corresponding to the first region E1 and the second region E2 (see chain double-dashed line in FIG. 4). In the graph g, the lead angle of a changing lead portion corresponding to the first portion 25 decreases at a constant rate in the first region E1 and the second region E2. In the case of the graph g, the winding angle corresponding to the first portion 25 is fixed to 360°, and the dimension of the changing lead portion is fixed. Therefore, when the lead angle decreases at a constant rate in the first region E1 and the second region E2, the maximum lead angle LM at the starting point of the winding angle (or at the end of the changing lead portion adjacent to the inlet port 17) is unambiguously determined. Although reduction rate of the lead angle of the graph G is not constant in the first region E1, the reduction rate of the lead angle of the graph G in the first region E1 does not exceed that of the graph g whose lead angle decreases at a constant rate in the first region E1 and the second region E2. Therefore, the maximum lead angle L1 of the graph G at the starting point of the winding angle in the first region E1 is smaller than the maximum lead angle LM of the graph g whose lead angle decreases at a constant rate in the first region E1 and the second region E2. Meanwhile, although the reduction rate of the lead angle of the graph G is not constant in the second region E2 either, the reduction rate of the lead angle of the graph G exceeds that of the graph g whose lead angle decreases at a constant rate in the first region E1 and the second region E2.

In the present embodiment, the straight line m shows the reduction rate of the lead angle of the graph G at the boundary T between the first region E1 and the second region E2. The gradient of the straight line m coincides with the reduction rate of the lead angle of the graph g whose lead angle decreases at a constant rate in the first region E1 and the second region E2. The above relationship between the lead angle and the winding angle of the rotor 20 is also true for the first portion 35 and the second portion 36 of the screw body 31 of the rotor 30. Since the winding angle of the first portion 25 has such the characteristics in the first region E1 and the second region E2, the volume of the pump space S1 formed on the first portions 25, 35 is set larger than that of a pump space (not shown) formed on the comparative changing lead portions whose lead angle decreases at a constant rate. It is noted that if the maximum lead angle of the first portions 25, 35 is set so as to exceed the maximum lead angle of the graph g whose lead angle decreases at a constant rate, the volume of the pump space is decreased compared to that of the conventional pump space for the graph g.

Operation of the screw pump 11 of the present embodiment will now be described. The inlet space P is transferred to a pump space S1 after the rotors 20, 30 have made one complete turn of 360°.

After the complete turn of the rotors 20, 30, a next inlet space P is formed at the inlet end of the rotors 20, 30. As described above, during the rotation of the rotors 20, 30, the fluid in the pump space S1 is transferred to the pump space S2. By rotating the rotors 20, 30 continuously, the fluid in the pump space S2 is transferred toward the outlet port 15 successively through the first portions 25, 35 and the second portions 26, 36 and finally discharged out from the outlet port 15. The second portions 26, 36 of the rotors 20, 30 prevent the fluid from flowing reversely toward the first portions 25, 35.

The screw pump 11 of the first embodiment has the following advantageous effects.

(1) The volume of the pump space S1 which is formed on the first portions 25, 35 and closed at the time of one turn of the rotors 20, 30 is larger than that of a pump space formed on the changing lead portions whose lead angle decreases at a constant rate. Therefore, the volume of the pump space S1 which is closed at the time of one turn of the rotors 20, 30 is enlarged compared to that of a conventional pump space, which improves working efficiency of drawing the fluid into the screw pump.

(2) Since the lead angle of the second portions 26, 36 is constant, there is scarcely pressure differential between the pump spaces S2 on the second portions 26, 36. Such pump spaces S2 easily prevent the fluid which is transferred from the first portions 25, 35 to the second portions 26, 36 from flowing reversely.

Figure 5:
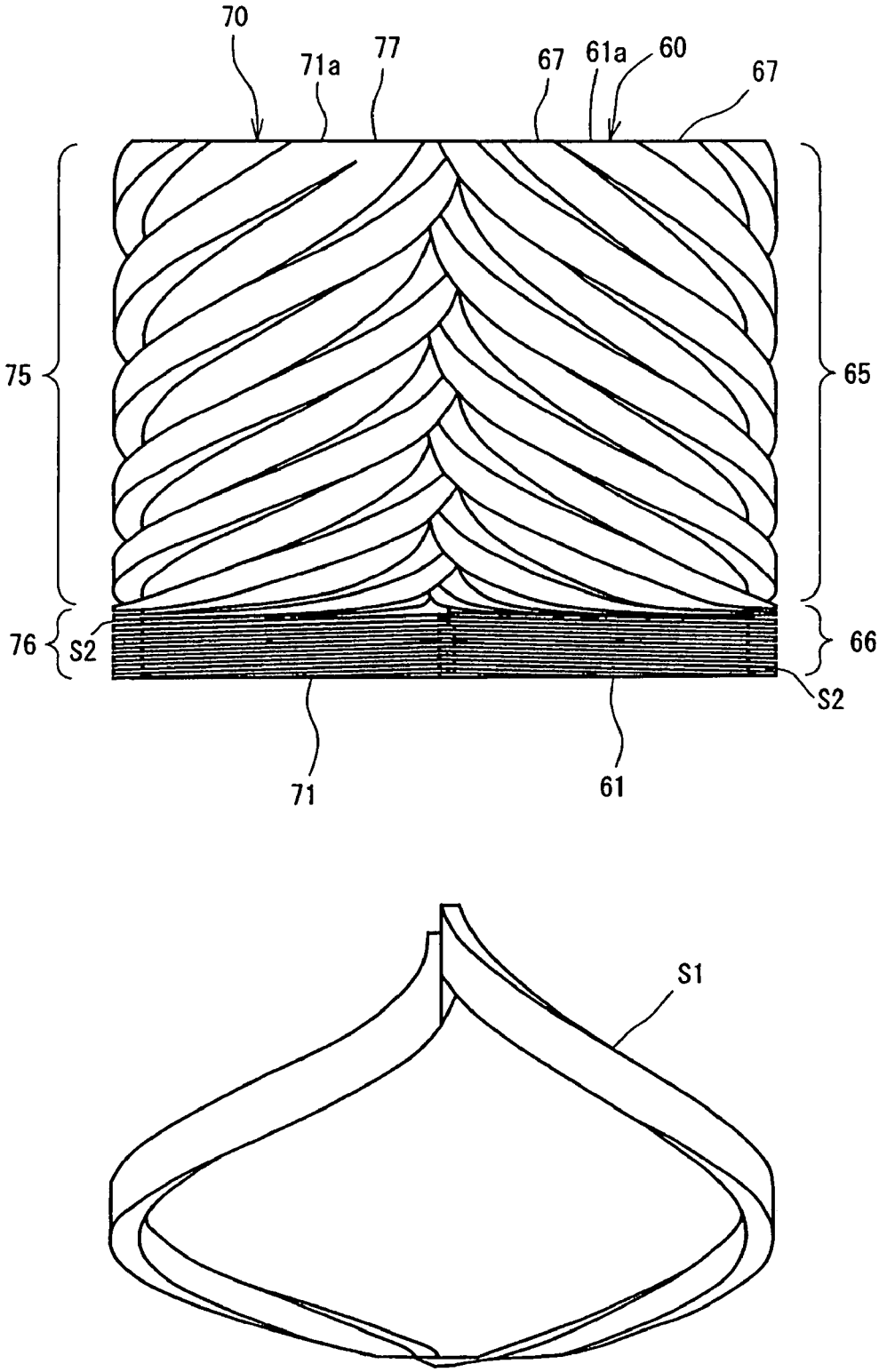
FIG. 5 is a front view showing relevant part of a screw pump according to a second embodiment of the present invention.
Figure 6:
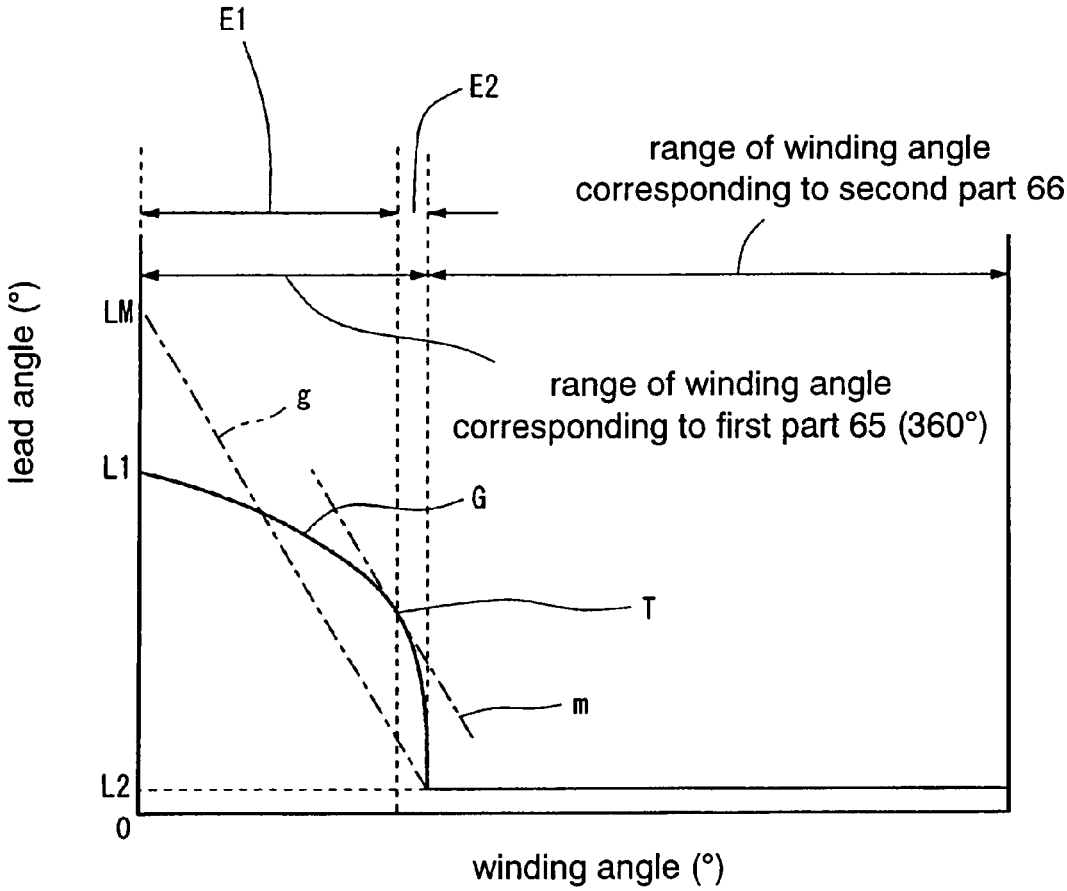
FIG. 6 is a graph showing relationship between winding angle and lead angle of the second embodiment.

The following will describe a screw pump according to a second embodiment of the present invention with reference to FIGS. 5 and 6. The screw pump of the present embodiment differs from that of the first embodiment in structure of the screw bodies of the rotors.

As shown in FIG. 5, the screw pump of the present embodiment includes a drive rotor 60 and a driven rotor 70, which have screw bodies 61, 71, respectively. The screw body 61 has a first portion 65 and a second portion 66. The screw body 71 also has a first portion 75 and a second portion 76. Each of the screw bodies 61, 71 of the present embodiment is of a multi-start thread. Therefore, an end face 61*a* of the screw body 61 adjacent to the inlet port is provided with a plurality of inlet openings 67. In a similar manner, an end face 71*a* of the screw body 71 adjacent to the inlet port is also provided with a plurality of inlet openings 77. The multi-start thread of the screw body 61 has the first portion 65 and the second portion 66, and the multi-start thread of the screw body 71 has the first portion 75 and the second portion 76. As shown in FIG. 5, the pump space S1 formed by the screw bodies 61, 71 and the rotor housing is shown separately from the rotors 60, 70. The rotors 60, 70 are shown on the upper side of FIG. 5 and the pump space S1 is shown on the lower side thereof.

FIG. 6 is a graph showing the relationship between the winding angle and the lead angle of the present embodiment. The screw body with a multi-start thread also shows substantially the same graph of the first embodiment. The graph G of FIG. 6 shows the decrease of the lead angle in a range from the starting point of the winding angle to a predetermined winding angle. The range of winding angle of the graph G ranging from the starting point of winding angle to the predetermined winding angle corresponds to the first portion 65. The range of winding angle of the graph G whose lead angle L2 is constant corresponds to the second portion 66.

FIG. 6 also shows the first region E1, the second region E2 and the graph g. The graph g corresponds to a changing lead portion whose lead angle decreases at a constant rate as the winding angle increases. The graph g shows that the maximum lead angle LM at the starting point of the winding angle (or at the end of the changing lead portion adjacent to the inlet port) is unambiguously determined. The screw pump of the second embodiment is substantially the same as that of the first embodiment in the following points (i)-(v). (i) The reduction rate of the lead angle is not constant in the first region E1 and the second region E2. (ii) The reduction rate of the lead angle of the graph G in the first region E1 does not exceed that of the graph g whose lead angle decreases at a constant rate. (iii) The reduction rate of the lead angle of the graph G in the second region E2 exceeds that of the graph g whose lead angle decreases at a constant rate. (iv) The maximum lead angle L1 at the starting point of the winding angle in the first region E1 is smaller than the maximum lead angle LM determined by the graph g whose lead angle decreases at a constant rate. (v) The reduction rate (shown by the straight line m) of the lead angle of the graph G at the boundary T between the first region E1 and the second region E2 coincides with that of the graph g whose lead angle decreases at a constant rate in the first region E1 and the second region E2.

To the contrary, the screw pump of the second embodiment differs from that of the first embodiment due to the multi-start thread in the ranges of the first region E1 and the second region E2, in the reduction rate of the lead angle in the first region E1 and the second region E2, and in the reduction rate of the lead angle of the graph g. It is noted that the same relationship between the winding angle and the lead angle of FIG. 6 is true for the first portion 75 and the second portion 76 of the screw body 71 of the rotor 70.

According to the second embodiment, when the winding angle of the first portions 65, 75 has such the characteristics in the first region E1 and the second region E2, the volume of the pump space S1 formed on the first portions 65, 75 is set larger than that of a pump space (not shown) formed on the changing lead portions whose lead angle decreases at a constant rate. Therefore, the screw pump of the second embodiment has substantially the same effects as those (1) and (2) of the first embodiment.

The present invention is not limited to the above first and second embodiments, but may be practiced in various ways within the scope of the invention.

Although in the above first and second embodiments the screw pump is of a vertical type wherein the axes of rotors thereof are vertically arranged, the present invention is also applicable to screw pumps having the axes of the rotors thereof disposed otherwise.

Although the screw pump in the above first and second embodiments has a screw body with a single-start thread or a multi-start thread, the number of threads is not limited. For example, a screw body with a double-start thread or triple-start thread may be employed. In addition, the number of helical turns corresponding to the winding angle of the thread of the screw body may be determined appropriately.

Figure 7:
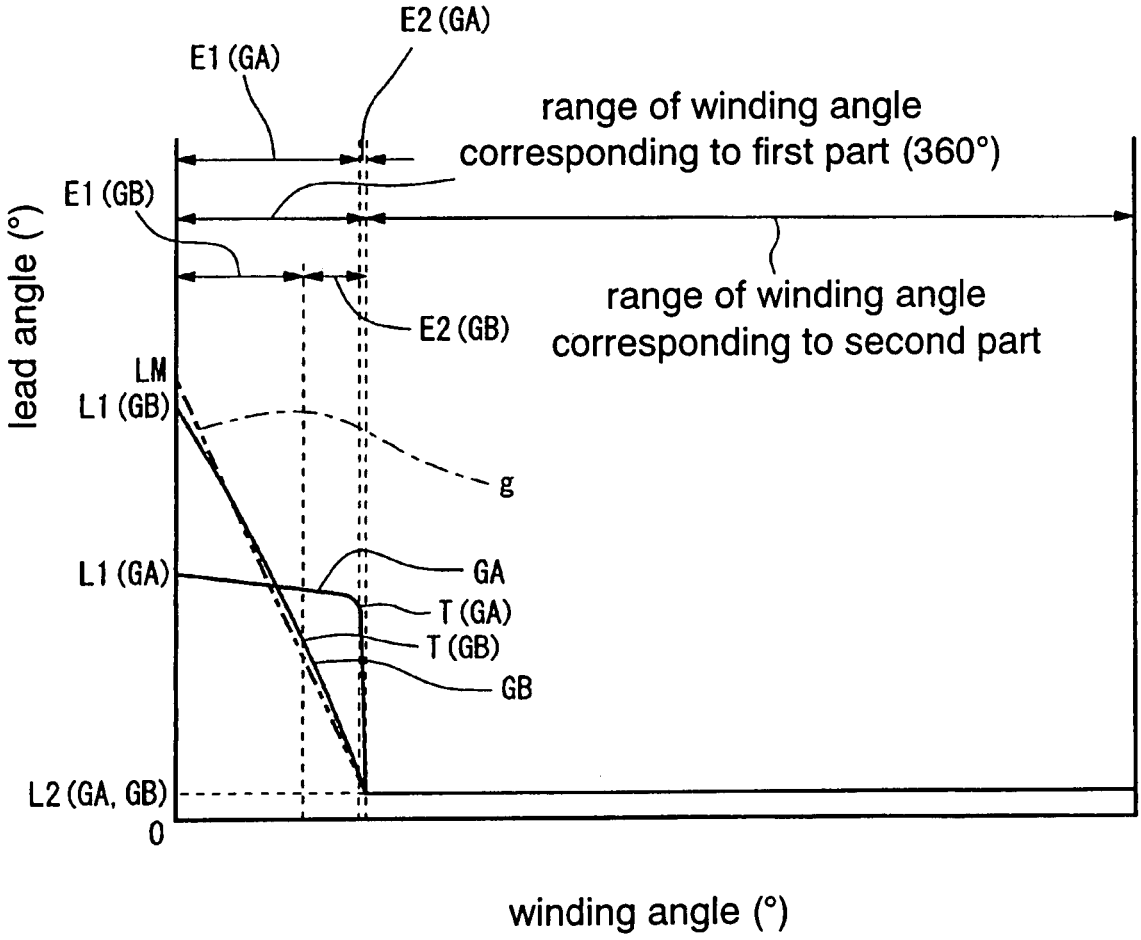
FIG. 7 is a graph showing relationships between winding angle and lead angle of screw pumps of the first and second examples.

Although in the above first and second embodiments the graphs G of FIGS. 4 and 6 are closely resembled curves with each other, the relationship between the winding angle and the lead angle of the first portion of the present invention is not limited to the graphs G. As the first example, a pair of intermeshing rotors each having a first portion and a second portion, which are defined by the graph GA shown in FIG. 7, may be subject to the present invention. As the second example, a pair of intermeshing rotors each having a first portion and a second portion, which are defined by the graph GB shown in FIG. 7, may also be subject to the present invention. In this case, the volume of the pump space S1 adjacent to the inlet space P which is defined by the graphs GA, GB is at least set larger than that of the pump space specified by the graph g whose lead angle decreases at a constant rate. It is noted that the volume differential between the pump space S1 specified by the graph GA and the pump space specified by the graph g whose lead angle decreases at a constant rate is larger than that between the pump space S1 for the graph GB and the pump space for the graph g. That is, the pump space S1 for the graph GA is more advantageous than that for the graph GB in the efficiency of drawing the fluid into the screw pump.

Therefore, the present examples and embodiments are to be considered as illustrative and not restrictive, and the invention is not to be limited to the details given herein but may be modified within the scope of the appended claims.

What is claimed is:

1. A screw pump comprising:

a housing having an inlet port at one end thereof and an outlet port at the other end thereof; and a pair of screw rotors disposed in the housing in engagement with each other, each rotor having a first portion whose lead angle decreases from an end on the rotor adjacent to the inlet port toward the outlet port, wherein the first portion and the housing form an inlet space and a pump space, wherein the inlet space is located at an end of the first portion adjacent to the inlet port and is in communication with the inlet port, wherein the pump space is closed adjacent to the inlet space, wherein winding angle of the first portion has a first region and a second region, wherein the first region is located in a predetermined range from the end on the first portion adjacent to the inlet port toward the outlet port, wherein the second region is located adjacent to the first region, wherein reduction rate of the lead angle of the first portion in the first region is set smaller than reduction rate of the lead angle of the first portion in the second region, and wherein a maximum lead angle of the first portion is set smaller than a maximum lead angle of a changing lead portion corresponding to the first portion whose lead angle decreases at a constant rate in the changing lead portion.

2. The screw pump according to claim 1, wherein the rotor has a second portion whose lead angle is constant, the second portion being located adjacent to the first portion.

3. The screw pump according to claim 1, wherein reduction rate of the lead angle of the first portion at a boundary between the first region and the second region coincides with reduction rate of the lead angle which decreases at a constant rate in the first region and the second region.

4. The screw pump according to claim 1, wherein each rotor is of a single-start thread.

5. The screw pump according to claim 1, wherein each rotor is of a multi-start thread.

* * * * *

UNITED STATES PATENT AND TRADEMARK OFFICE

CERTIFICATE OF CORRECTION

PATENT NO. : 7,484,943 B2
APPLICATION NO. : 11/891532
DATED : February 3, 2009
INVENTOR(S) : Yuya Izawa et al.

It is certified that error appears in the above-identified patent and that said Letters Patent is hereby corrected as shown below:

Title Page, Item

(56) References Cited, please delete "JP 2001-182679 6/2001"; and

(56) References Cited, please delete "JP 2001-193677 6/2001".

Signed and Sealed this

First Day of September, 2009

David J. Kappos

David J. Kappos
*Director of the United States Patent and Trademark Office*